US005398011A

United States Patent [19]

Kimura et al.

[11] Patent Number: 5,398,011

[45] Date of Patent: Mar. 14, 1995

[54] MICRORELAY AND A METHOD FOR PRODUCING THE SAME

[75] Inventors: Kasuhiro Kimura, Sakai; Susumu Hirata, Ikoma; Yorishige Ishii, Yamatotakada; Tetsuya Inui, Nara; Kenji Ohta, Kitakatsuragi, all of Japan

[73] Assignee: Sharp Kabushiki Kaisha, Osaka, Japan

[21] Appl. No.: 61,254

[22] Filed: May 17, 1993

[30] Foreign Application Priority Data

Jun. 1, 1992 [JP] Japan ..... 4-166981

[51] Int. Cl.[6] ..... H01H 51/22

[52] U.S. Cl. ..... 335/79; 361/819; 323/264

[58] Field of Search ..... 335/78-86, 335/124, 128; 361/741, 819; 323/264

[56] References Cited

U.S. PATENT DOCUMENTS

| | | | |
|---|---|---|---|
| 3,325,722 | 6/1967 | Romberg | 323/264 |
| 4,668,928 | 5/1987 | Davis et al. | 335/78 |
| 4,826,131 | 5/1989 | Mikkor . | |
| 5,133,543 | 10/1992 | Hitachi et al. | 335/78 |

FOREIGN PATENT DOCUMENTS

| | | |
|---|---|---|
| 1-287470 | 11/1989 | Japan . |
| 2095911A | 10/1982 | United Kingdom . |

OTHER PUBLICATIONS

1989 *IEEE*, pp. 149-151, Sakata, "An electrostatic Microactuator for Electro-Mechanical Relay".

*Primary Examiner*—Lincoln Donovan

*Attorney, Agent, or Firm*—Nixon & Vanderhye

[57] ABSTRACT

A microrelay including a substrate having a pair of fixed contacts fixed on a surface thereof and a movable section having a pair of movable contacts opposed to the pair of fixed contacts. The movable section includes a frame for fixing the movable section to the substrate; a movable body having the pair of movable contacts and a pair of magnetic bodies; and a coupling section for pivotally supporting the movable body to the frame. The substrate has a pair of magnetic force generating devices for supplying the pair of magnetic bodies with a magnetic force, thereby selectively causing contact between one of the pair of movable contacts and the fixed contact opposed to the one of the pair of movable contacts; and a magnetic force controlling device for applying the magnetic force generated by each of the pair of magnetic force generating devices only to the magnetic body corresponding to each of the magnetic force generating device. A method for producing such a microrelay includes the steps of depositing an insulating film on the surface of the substrate; forming the pair of fixed contacts each formed of a conductive film on the insulating film; and forming a groove at the surface of the substrate between the pair of fixed contacts.

14 Claims, 13 Drawing Sheets

300

310
310
300

300

310
300

320
320
320
320
300

320
320
320
310
300

300
310

300
310
330

300
335
331
332
333
334
337

335
331
332
336
337
334
333
338
210

300
335
222L
223L
223R
222R
337

MICRORELAY AND A METHOD FOR PRODUCING THE SAME

BACKGROUND OF THE INVENTION

1. Field of the Invention

The present invention relates to a microrelay which is a micromachine used as, for example, a mechanical switch and an actuator.

2. Description of the Related Art

With reference to FIGS. 11 through 13, a conventional microrelay will be described.

The conventional microrelay shown in FIG. 11 includes a substrate 500 having two sets of fixed contacts 510*a* and 510*b* fixed thereon (only one set of the fixed contacts 510*a* and 510*b* are shown in FIG. 11) and a movable section 600 having two movable contacts 621L and 621R corresponding to the fixed contacts 510*a* and 510*b*. The substrate 500 has a top surface and a bottom surface, each of which has two grooves 520L and 520R. A covered conductive wire 530 is provided in the grooves 520L to be wound around the substrate 500, and another covered conductive wire 530 is provided in the grooves 520R to be wound around the substrate 500, thereby forming electromagnetic coils 550L and 550R each acting as a magnetic force generating device.

The movable section 600 includes a frame 610 and a movable body 620 coupled to the frame 610 through a coupling section 630. The movable body 620 has magnetic bodies 622L and 622R in addition to the movable contacts 621L and 621R. When one of the two electromagnetic coils 550L and 550R is excited, the movable body 620 is pivoted as a seesaw about the coupling section 630 as a pivoting axis, thereby contacting one of the movable contacts 621L and 621R which corresponds to the excited electromagnetic coil on the corresponding fixed contact 510*a* or 510*b* (FIG. 12). In this manner, the fixed contact and the movable contact in contact with each other become conductive to each other.

The above-mentioned conventional microrelay has the following problems.

For example, when the coil 550L is excited, a magnetic flux is transmitted through the magnetic body 622L and also through the other magnetic body 622R (FIG. 13). Accordingly, the movable body 620 is not actually pivoted about the coupling section 630 as an axis, but is entirely attracted to the substrate 500. Since the pressure load applied on the fixed contact 510*a* by the movable contact 621L is insufficient in this state, the utilization factor of the magnetic flux is low. Such inconveniences prevent the microrelay from being produced compactly. Further, when the magnetic body 622R is attracted to the substrate 500, and thus the movable contact 621R approaches the fixed contact 510*b*, high frequency signals are transmitted between the movable contact 621R and the fixed contact 510*b*, resulting in a decline in the signal blocking capability of the microrelay.

SUMMARY OF THE INVENTION

In a microrelay according to the present invention including a substrate having a pair of fixed contacts fixed on a surface thereof and a movable section having a pair of movable contacts opposed to the pair of fixed contacts, the movable section includes a frame for fixing the movable section to the substrate; a movable body having the pair of movable contacts and a pair of magnetic bodies; and a coupling section for pivotally supporting the movable body to the frame. The substrate has a pair of magnetic force generating devices for supplying the pair of magnetic bodies with a magnetic force, thereby selectively causing contact between one of the pair of movable contacts and the fixed contact opposed to the one of the pair of movable contacts; and a magnetic force controlling device for applying the magnetic force generated by each of the pair of magnetic force generating devices only to the magnetic body corresponding to each of the magnetic force generating device.

According to the present invention, a method for producing a microrelay including a substrate having at least one pair of fixed contacts on a surface thereof and a movable section having a pair of movable contacts opposed to the pair of fixed contacts, the method comprising the steps of depositing an insulating film on the surface of the substrate; forming the pair of fixed contacts each formed of a conductive film on the insulating film; and forming a groove at the surface of the substrate between the pair of fixed contacts.

Thus, the invention described herein makes possible the advantage of providing a microrelay which realizes efficient utilization of a magnetic flux, compactness in size, and a sufficient pressure load on a fixed contact.

This and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrating examples with reference to the accompanying drawings.

Figure 1A:
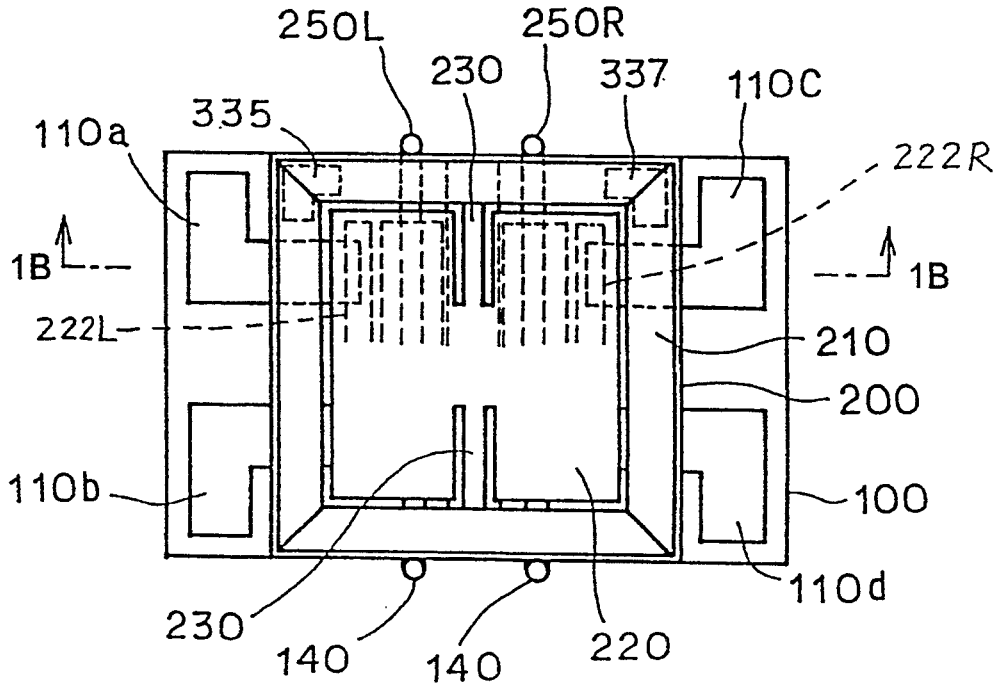
FIG. 1A is a plan view of a microrelay according to an example of the present invention.
Figure 1B:
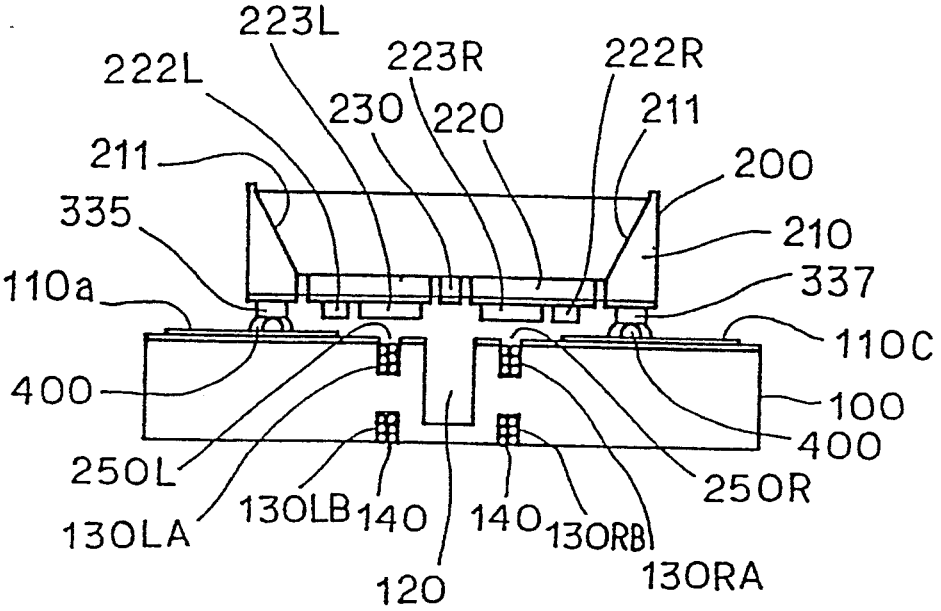
FIG. 1B is a cross sectional view of the microrelay shown in FIG. 1A along lines 1B—1B.

As is shown in FIGS. 1A and 1B, a microrelay according to an example of the present invention includes a substrate 100 having two pairs of fixed contacts 110*a*, 110*b*, 110*c* and 110*d* fixed on a top surface thereof and a movable section 200 having a pair of movable contacts 222L and 222R. The movable contact 222L is opposed to the fixed contacts 110*a* and 110*b*, and the movable contact 222R is opposed to the fixed contacts 110*c* and 110*d*.

The substrate 100 typically has a thickness of 1.0 mm, a length 10 mm and a width of 5 mm. The positions of the fixed contacts 110*a* through 110*d* are clearly shown in FIG. 4A.

Figure 3A:
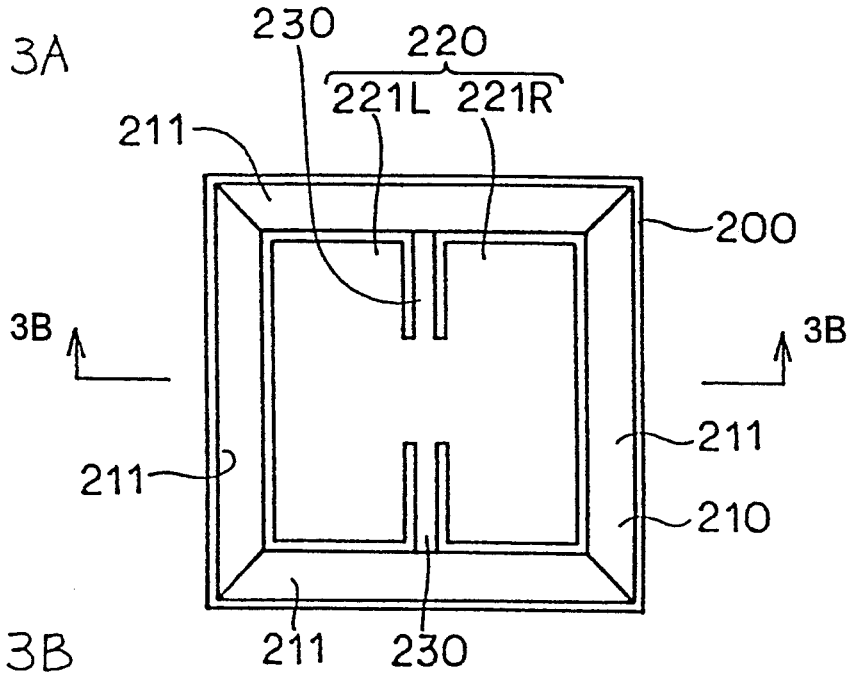
FIG. 3A is a plan view of a movable section used for the microrelay shown in FIG. 1A.
Figure 3B:
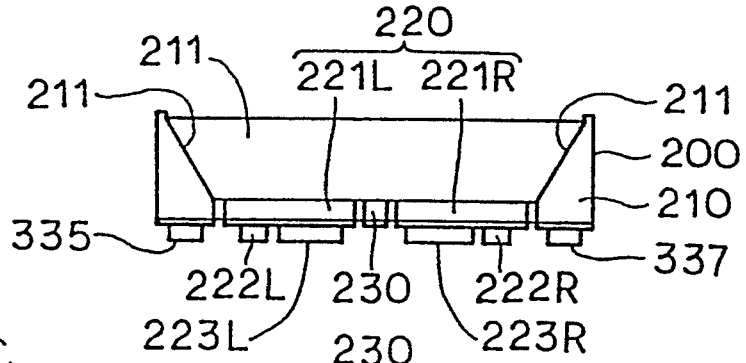
FIG. 3B is a cross sectional view of the movable section shown in FIG. 3A along lines 3B—3B.

The movable section 200 includes a frame 210 for fixing the movable section 200 to the substrate 100, a movable body 220 having movable contacts 222L and 222R, and a pair of coupling sections 230 for pivotally supporting the movable body 220 to the frame 210. As is described later, the movable section 200 is formed from a silicon substrate by use of a semiconductor fabrication technology. The movable section 200 further includes a pair of magnetic bodies 223L and 223R. As is shown in FIGS. 3A and 3B, the frame 210 is formed of four slope sections 211 and has an opening at a center thereof. The movable body 220 is substantially H-shaped, namely, includes two wings 221L and 221R which are connected to each other at a central portion thereof. The coupling sections 230 are projected from the central portion of the movable body 220 and then extended to the frame 210.

Figure 3C:
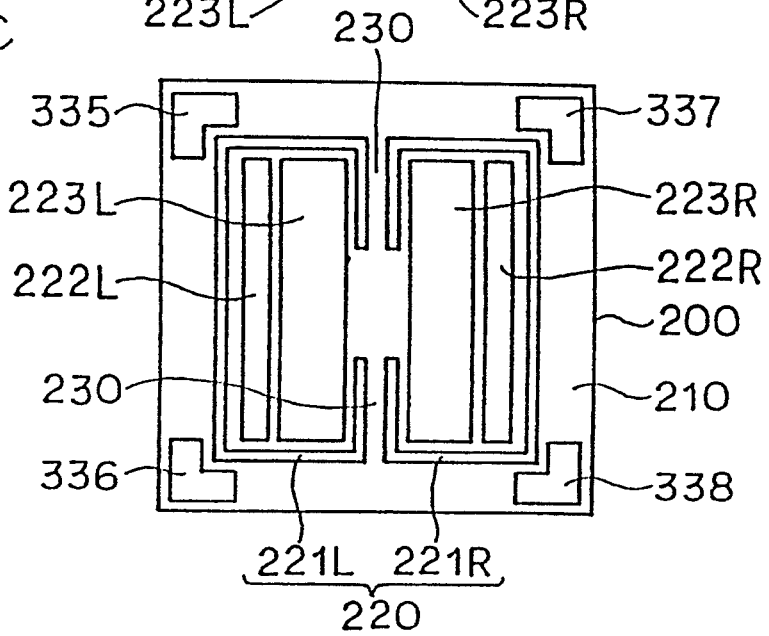
FIG. 3C is a bottom view of the movable section shown in FIG. 3A.

As is shown in FIG. 3C, the wing 221L of the movable body 220 has the movable contact 222L on a bottom surface thereof, and the wing 221R of the movable body 220 has the movable contact 222R on a bottom surface thereof. The movable contacts 222L and 222R are each a magnetic strip (length: 3 mm; width: 0.5 mm) extended parallel to the coupling section 230. The movable contacts 222L and 222R are adjusted so that the movable contacts 222L and 222R can contact to the fixed contacts 110*a* through 110*d*.

The magnetic body 223L is provided between the movable contact 222L and a central portion of the bottom surface of the movable body 220, and the magnetic body 223R is provided between the movable contact 222R and the central portion of the bottom surface of the movable body 220. The magnetic bodies 223L and 223R are each a conductive strip (length: 3 mm; width: 2 mm) extended parallel to the movable contacts 222L and 222R. The magnetic bodies 223L and 223R receive a magnetic force from a pair of magnetic force generating devices provided on the substrate 100, respectively.

In this example, electromagnetic coils 250L and 250R are provided on the substrate 100 as the pair of magnetic force generating devices. When one of the electromagnetic coils 250L and 250R is selectively electrified, the magnetic body 223L or 223R which corresponds to the electrified electromagnetic coil generates a magnetic force, namely, is excited. The power to be applied to the electromagnetic coil 250L or 250R is, for example, 450 mW. In this example, the substrate 100 provided with the electromagnetic coils 250L and 250R is formed of a ferrite material for efficient generation of a magnetic force. The substrate 100 may be formed of any other material which is insulating.

By the magnetic force applied to the magnetic body 223L or 223R, the movable body 220 receives a couple, and as a result, the movable body 220 is pivoted about the coupling section 230 as a pivoting axis. In this manner, the movable contact 222L or 222R which corresponds to the magnetic body provided with the magnetic force contacts the fixed contacts 110*a* and 110*b* or the fixed contacts 110*c* and 110*d* which correspond to the magnetic body provided with the magnetic force. By such contact, the movable contact and the fixed contacts which mechanically contact each other are electrically connected to each other through wires (not shown) connected thereto.

Figure 10A:
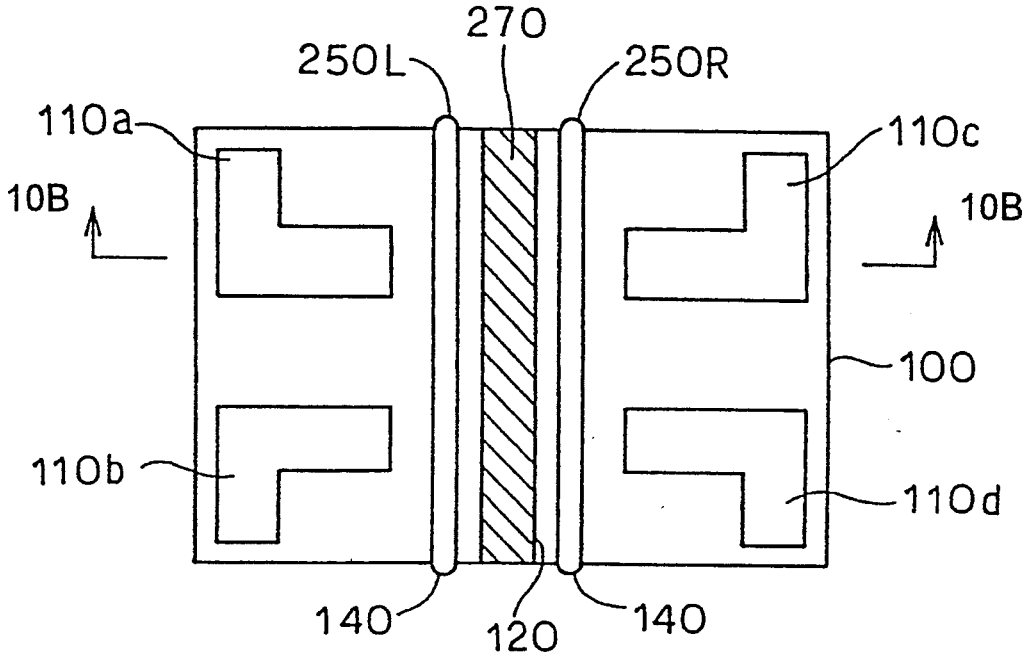
FIG. 10A is a plan view of a substrate section used for a microrelay according to a modified example of the present invention.
Figure 10B:
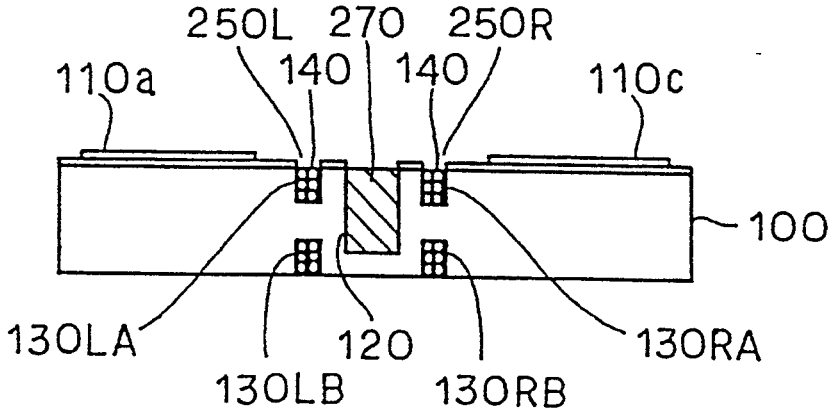
FIG. 10B is a cross sectional view of the substrate section shown in FIG. 10A along lines 10B—10B.
Figure 11:
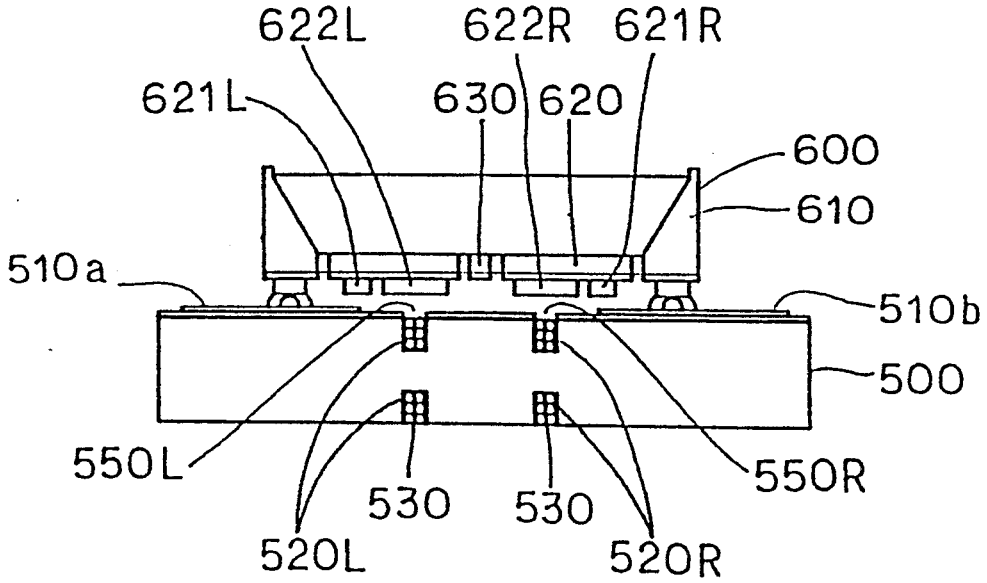
Fig. 11 (PRIOR ART)
FIG. 11 is a schematic cross sectional view of a conventional microrelay.
Figure 12:
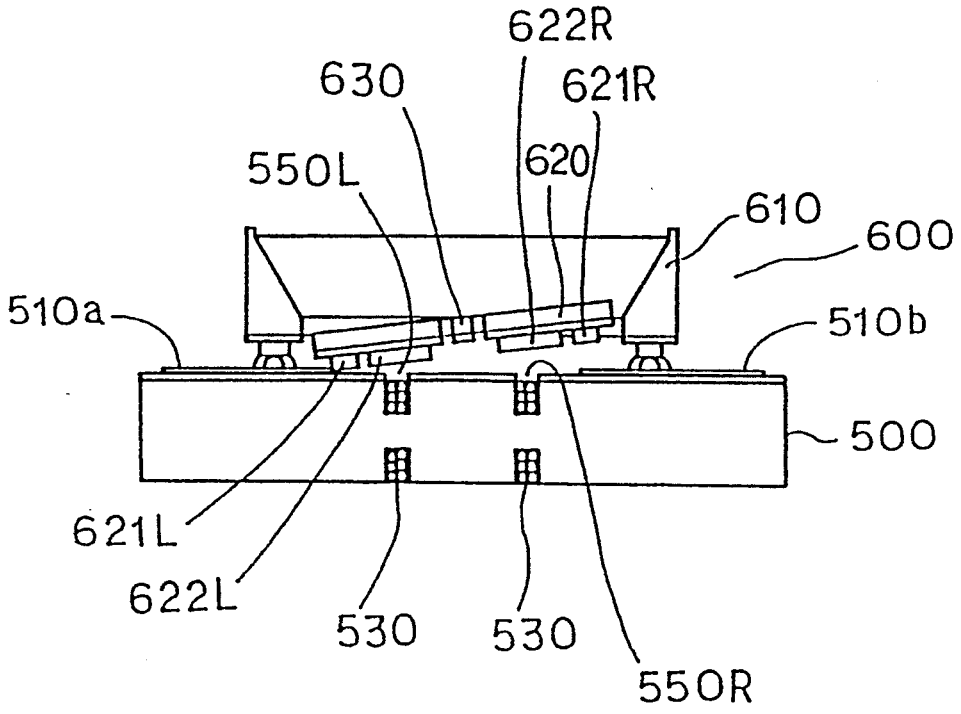
Fig. 12 (PRIOR ART)
FIG. 12 is a view illustrating one operation of the conventional microrelay shown in FIG. 11.
Figure 13:
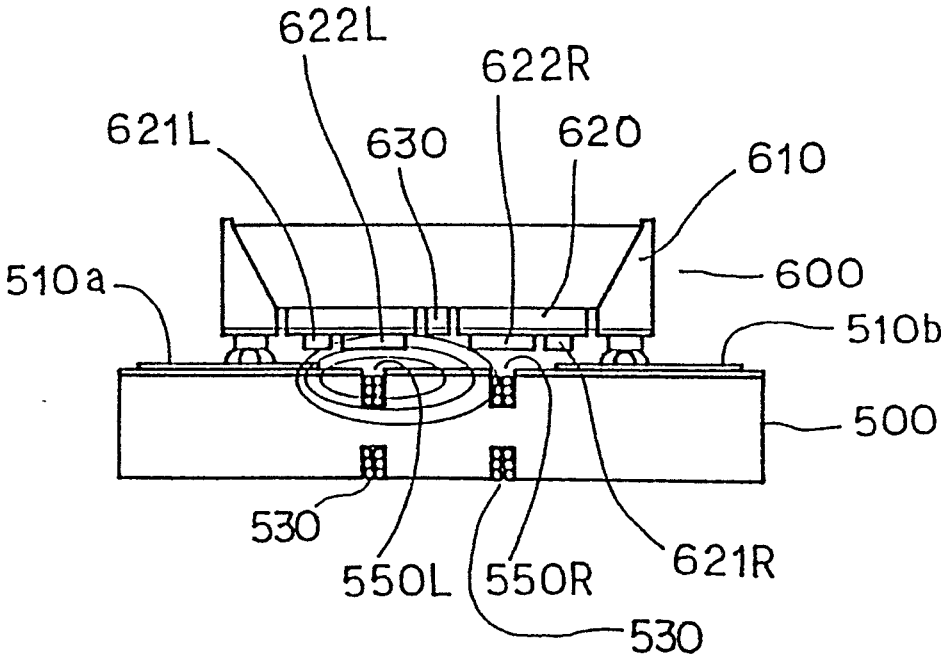
Fig. 13 (PRIOR ART)
FIG. 13 is a view showing one problem of the conventional microrelay shown in FIG. 11.

According to this example, the microrelay further includes a magnetic force controlling device for allowing a magnetic force generated by the electromagnetic coil 250L to be applied only to the corresponding magnetic body 223L and allowing a magnetic force generated by the electromagnetic coil 250R to be applied only to the corresponding magnetic body 223R. The magnetic force controlling device is a groove 120 formed at the top surface of the substrate 100 (FIG. 1B). The groove 120 is positioned between the fixed contacts 110*a*, 110*b* and 110*c*, 110*d*. The groove 120 typically has a depth of 0.7 mm, a length of 5 mm, and a width of 1 mm. Preferably, as is shown in FIGS. 10A and 10B, the groove 120 is filled with a diamagnetic member 270 formed of a material such as antimony or bismuth.

A method for producing the microrelay according to this example will be described along with a detailed construction thereof, hereinafter.

First, an insulating film (thickness: 1 $\mu$m) formed of $SiO_2$ is deposited on the top surface of the substrate 100 formed of a ferrite material by evaporation. Then, a conductive film (thickness: 5 $\mu$m) is deposited on the insulating film by evaporation or sputtering. The conductive film is preferably formed of Au, Ag or the like which has a low electric resistance.

Figure 4A:
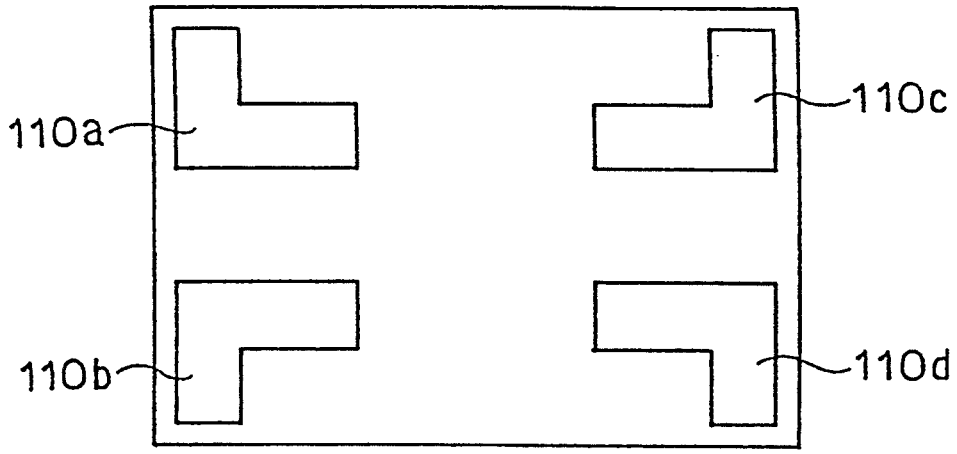
FIG. 4A is a plan view illustrating a step for producing the substrate section shown in FIG. 2A.
Figure 4B:
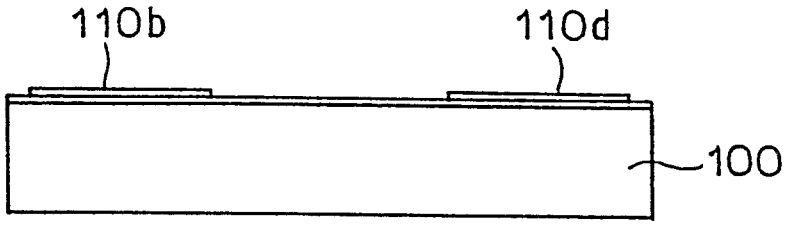
FIG. 4B is a side view of the substrate section in the state shown in FIG. 4A.

Next, a photoresist film having a pattern which defines profiles of the fixed contacts 110*a* through 110*d* as viewed from above is formed on the conductive film. An exposed portion of the conductive film is etched away using the photoresist as a mask, thereby forming the fixed contacts 110*a* through 110*d* (FIGS. 4A and 4B). In this example, the conductive film is etched so as to form each of the fixed contacts 110*a* through 110*d* to be L-shaped as is shown in FIG. 4A. Further in this example, two pairs of fixed contacts 110*a*, 110*c* and 110*b*, 110*d* are formed.

Figure 5A:
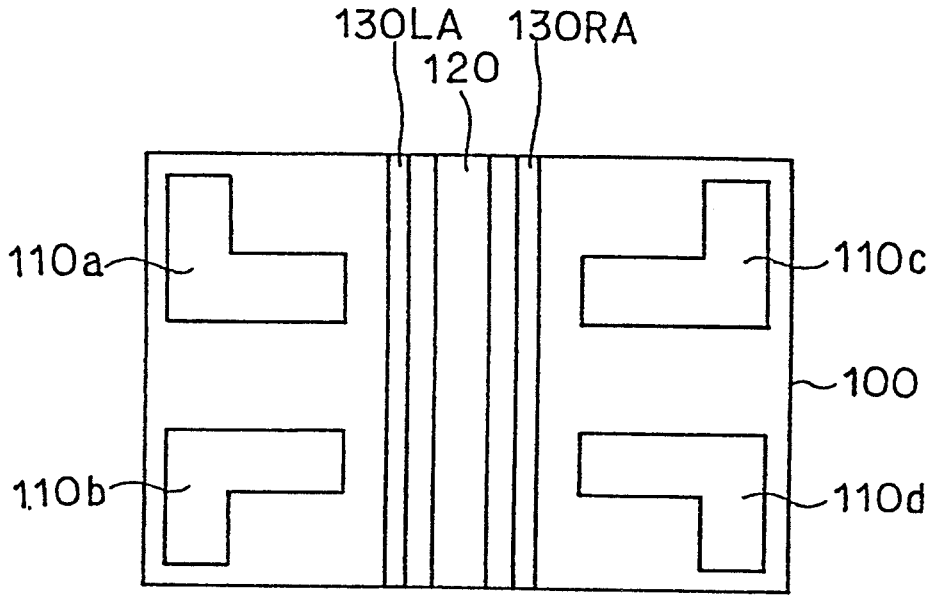
FIG. 5A is a plan view illustrating another step for producing the substrate section shown in FIG. 3A.
Figure 5B:
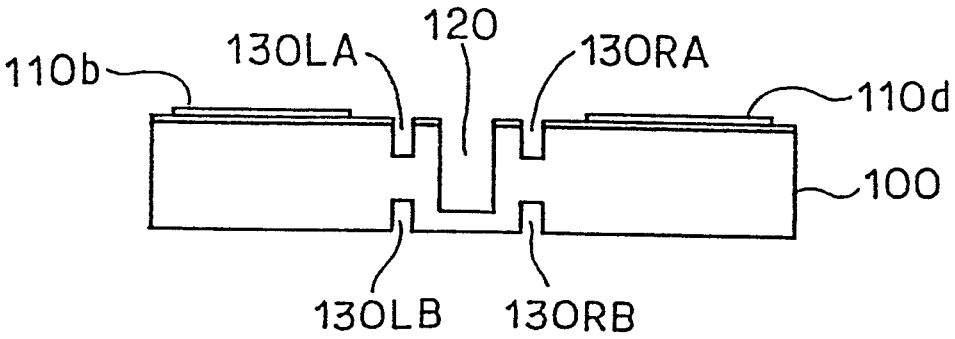
FIG. 5B is a side view of the substrate section in the state shown in FIG. 5A.

Then, as is shown in FIGS. 5A and 5B, the groove 120 is formed at the top surface of the substrate 100 between the fixed contacts 110*a*, 110*b* and the fixed contacts 110*c*, 110*d*. Further, a groove 130LA is formed at the top surface of the substrate 100 between the fixed contacts 110*a*, 110*b* and the groove 120, and another groove 130LB is formed at the bottom surface of the substrate 100 at a portion opposed to a portion between the fixed contacts 110*a*, 110*b* and the groove 120. A groove 130RA is formed at the top surface of the substrate 100 between the fixed contacts 110*c*, 110*d* and the groove 120, and another groove 130RB is formed at the bottom surface of the substrate 100 at a portion opposed to a portion between the fixed contacts 110*c*, 110*d* and the groove 120. The grooves 130LA, 130LB, 130RA and 130RB are formed by dicing.

Figure 2A:
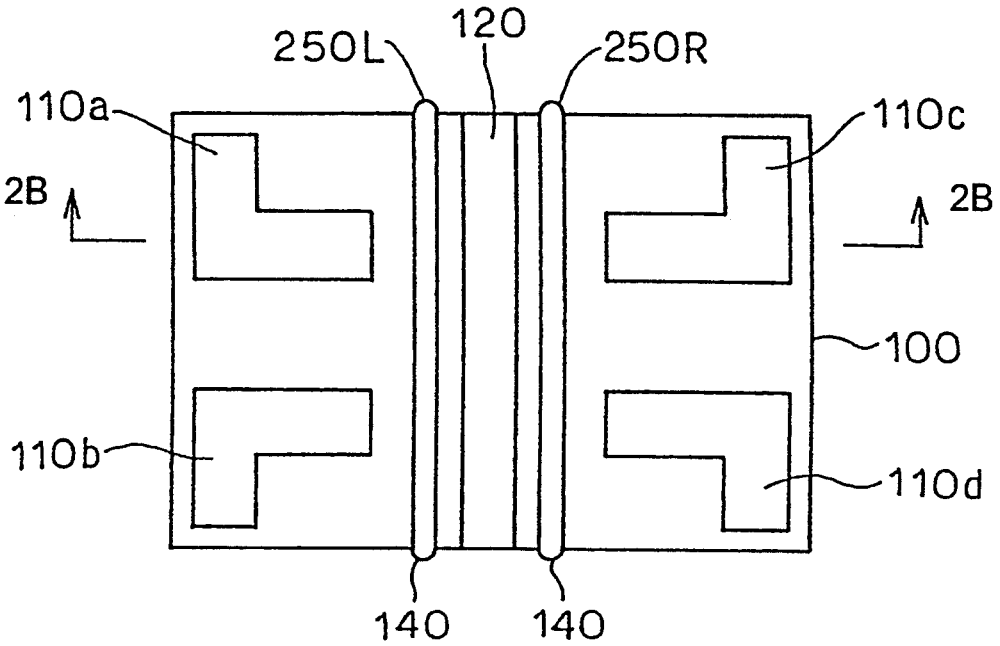
FIG. 2A is a plan view of a substrate section used for the microrelay shown in FIG. 1A.
Figure 2B:
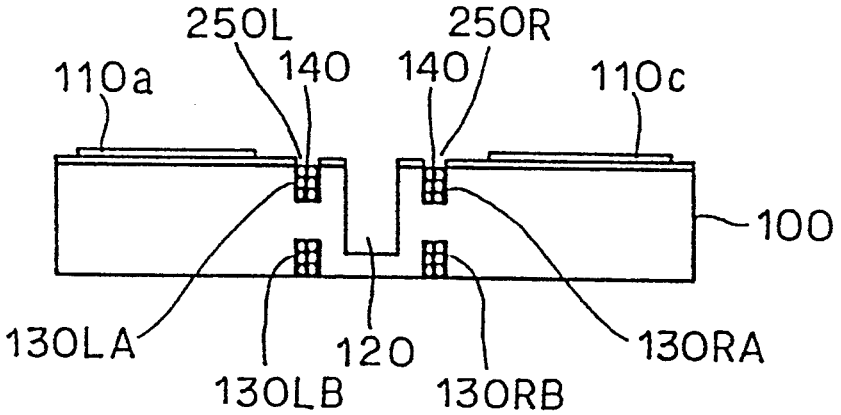
FIG. 2B is a cross sectional view of the substrate section shown in FIG. 2A along lines 2B—2B.

In this state, a conductive wire 140 is provided along the grooves 130LA and 130LB, thereby forming the electromagnetic coil 250L (FIGS. 2A and 2B). Similarly, another conductive wire 140 is provided along the grooves 130RA and 130RB, thereby forming the electromagnetic coil 250R. Thus, a substrate section of the microrelay is completed.

The groove 120 has a function of prohibiting transmission of a magnetic flux Generated by the electromagnetic coil 250L through the magnetic body 223R, and prohibiting transmission of a magnetic flux generated by the electromagnetic coil 250R through the magnetic body 223L.

The movable section 200 is produced by processing a single crystalline silicon substrate by use of a semiconductor fabrication technology in the following manner.

Figures 6A, 6B, 6C, 6D, 6E, 6F:
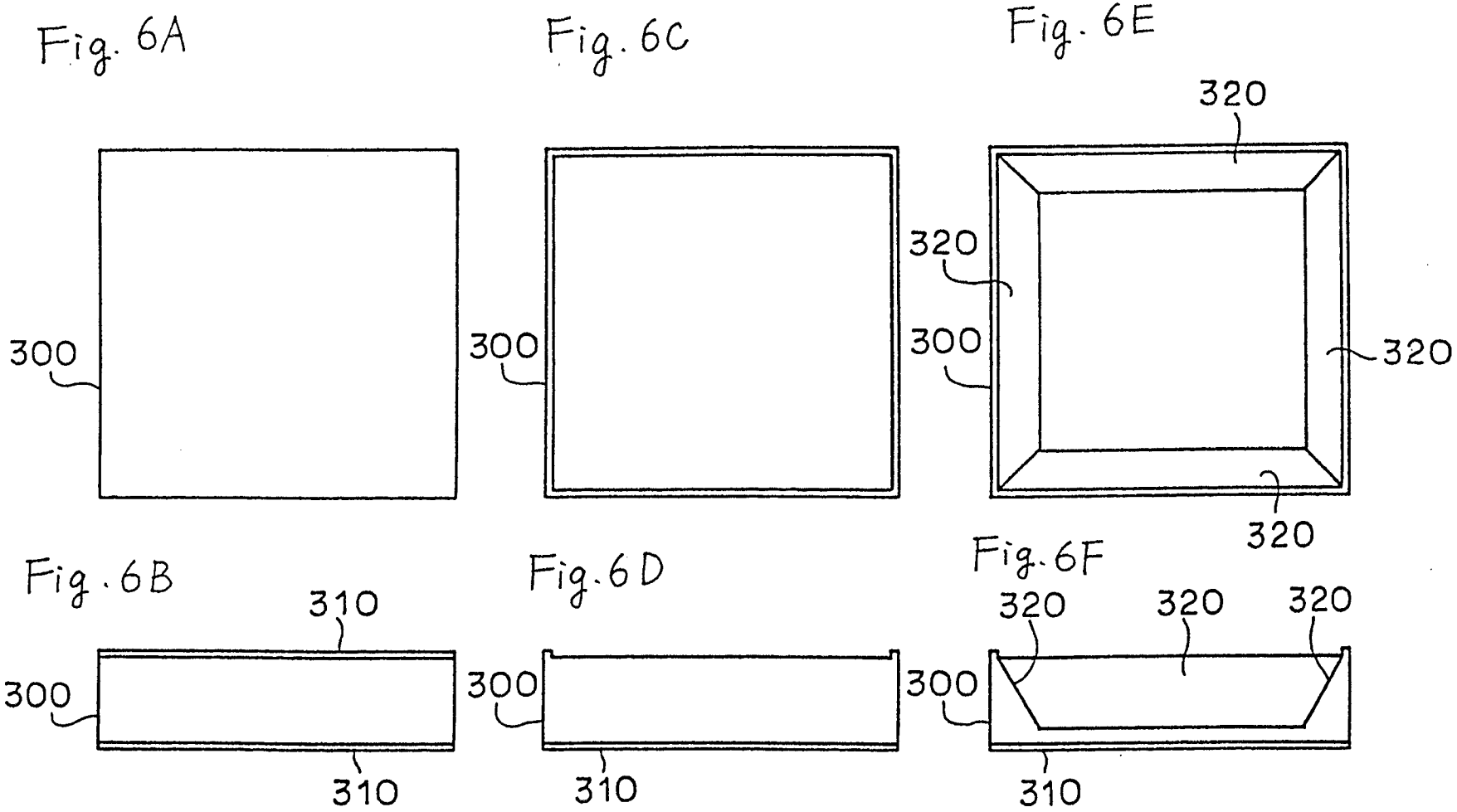
FIGS. 6A through 6F are views illustrating steps for producing the movable section shown in FIG. 3A.

First, as is shown in FIGS. 6A and 6B, thermally oxidized films 310 are formed on a top surface and a bottom surface of a silicon substrate 300 having an orientation of (100). During the formation of the thermally oxidized films 310, another thermally oxidized film (not shown) is formed on a side surface of the silicon substrate 300. The thermally oxidized films 310 will each function as a mask used for anisotropic etching which will be described later. Each thermally oxidized film 310 typically has a thickness of b 0.1 to 1.0 μm.

Next, as is shown in FIGS. 6C and 6D, a portion of the thermally oxidized film 310 formed on the top surface of the silicon substrate 300 is selectively etched away except for a perimeter thereof. The perimeter typically has a width of 0.5 to 1.0 mm. Then, as is shown in FIGS. 6E and 6F, an exposed portion of the silicon substrate 300 is selectively etched by use of an etchant such as potassium hydroxide, thereby forming a recess portion (depth: 0.3 to 0.8 mm). Such etching is an isotropic etching in which the etching rate changes in accordance with the orientation of silicon crystals. In this manner, four slope sections 320 each showing an orientation of, for example, (111) are formed. The slope sections 320 correspond to the slope sections 211 shown in FIG. 3A. These four slope sections 320 constitute the frame 210. The etchant and the orientation are not limited to the above-mentioned ones.

Figures 7A, 7B, 7C, 7D, 7E, 7F:
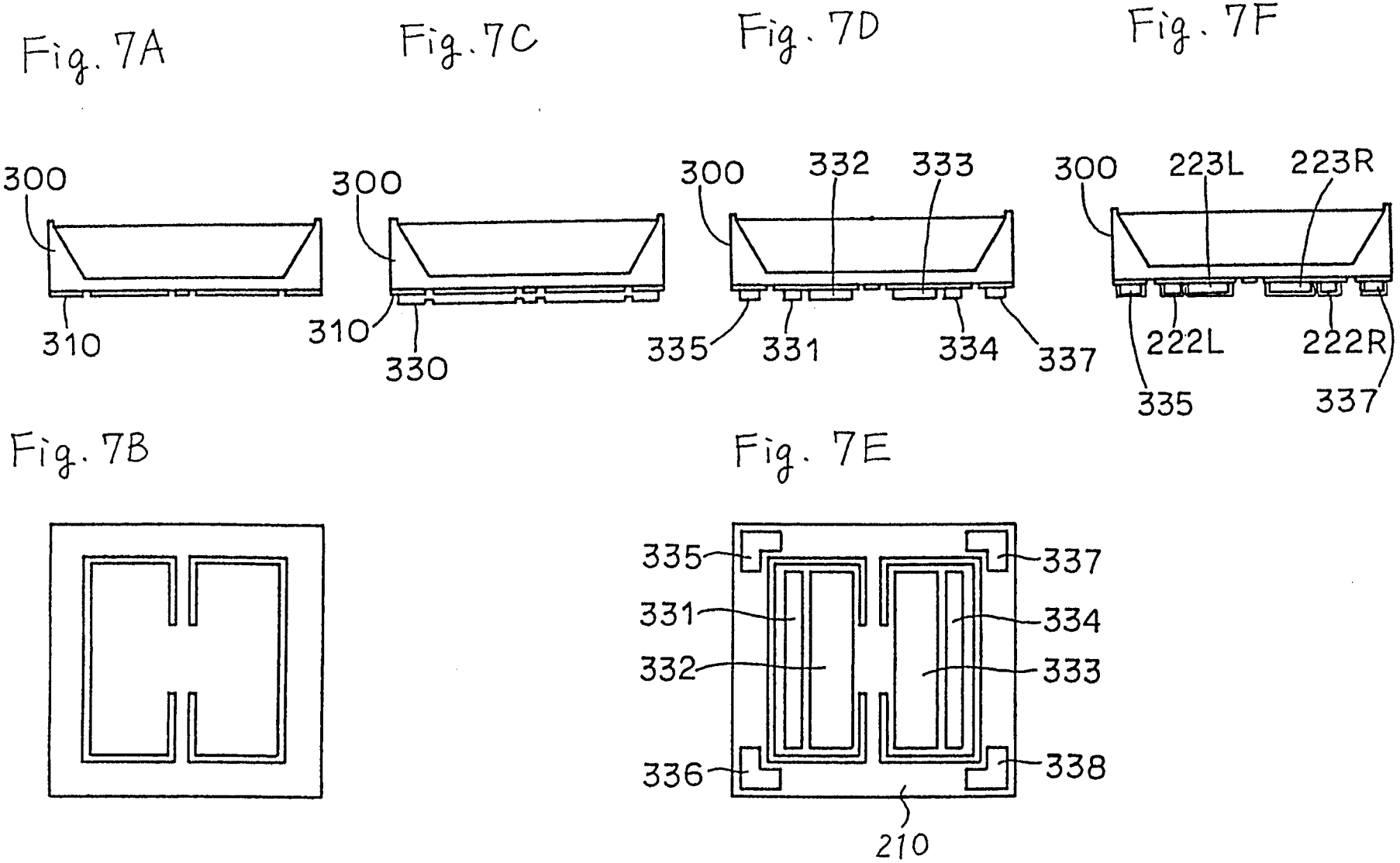
FIGS. 7A through 7F are views illustrating further steps for producing the movable section shown in FIG. 3A.

After that, a photoresist having a pattern which defines a profile of the movable body 220 as viewed from above is formed on the thermally oxidized film 310 formed on the bottom surface of the silicon substrate 300. Then, the thermally oxidized film 310 on the bottom surface is selectively etched away using the photoresist as a mask by an etchant such as hydrogen fluoride, thereby exposing portions of the bottom surface as is shown in FIGS. 7A and 7B. The exposed portion typically has a width of 0.1 to 0.5 mm.

Then, as is shown in FIG. 7C, the bottom surface of the silicon substrate 300 partially having the thermally oxidized film 310 thereon is entirely plated with a magnetic film 330. The magnetic film 330 typically has a thickness of 10 to 100 μm, and is preferably formed of a soft magnetic material such as permalloy.

Then, a photoresist having a pattern which defines profiles of the movable contacts 222L and 222R and the magnetic bodies 223L and 223R as viewed from above is formed on the magnetic film 330. An exposed portion of the magnetic film 330 is etched away, thereby forming projections 331 through 334 as is shown in FIGS. 7D and 7E. The projections 331, 332, 333 and 334 will be processed into the movable contact 222L, the magnetic bodies 223L and 223R, and the movable contact 222R, respectively. Simultaneously with the formation of the projections 331 through 334, leg portions 335 through 338 are formed at four corners of the frame 210. The legs portions 335 through 338 are each formed to be L-shaped for fixing the movable section 200 to the substrate 100.

Next, an Au layer is deposited on a surface of each of the projections 331 through 334 by electric plating, thereby forming the magnetic bodies 223L and 223R and the movable contacts 222L and 222R. The Au layer typically has a thickness of 1 to 5 μm.

After that, the silicon substrate 300 is immersed in a solution of potassium hydroxide, thereby etching portions of the silicon substrate 300 which are not covered with the thermally oxidized film 310. The etching is continued until the lengthy exposed portions shown in FIG. 7B are completely removed. As a result the movable body 220 is separated from the frame 210 except for portions acting as the coupling sections 230. Accordingly, the movable body 220 becomes pivotal about the coupling sections 230 as an axis. The Au layer is etched very little by the solution of potassium hydroxide.

The movable section 200 produced in this manner is coupled to the substrate 100 by bonding the leg portions 335 through 338 to the substrate 100 through an adhesive 400 (FIG. 1B). The adhesive 400 preferably contains a glass fiber mixed therein. The movable section 200 is positioned on the substrate 100 so that the movable contact 222L covers tips of the fixed contacts 110*a* and 110*b* and the movable contact 222R covers tips of the fixed contacts 110*c* and 110*d* (FIG. 1A).

Figure 9:
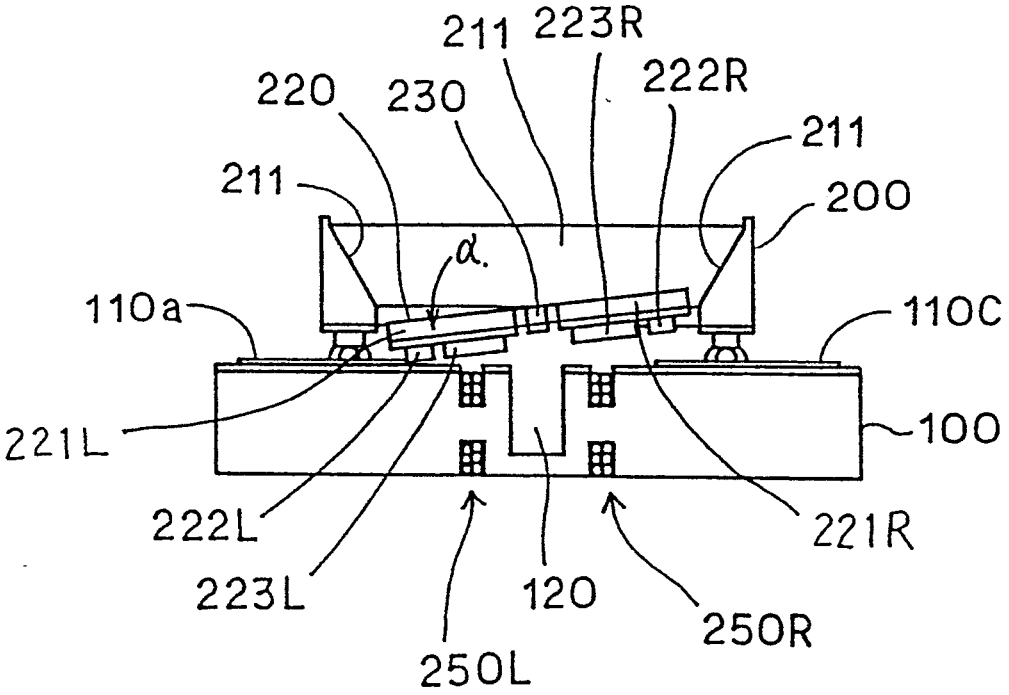
FIG. 9 is a view explaining an operation of the microrelay shown in FIG. 1A.

With reference to FIG. 9, an operation of the microrelay according to this example will be described.

Figure 8:
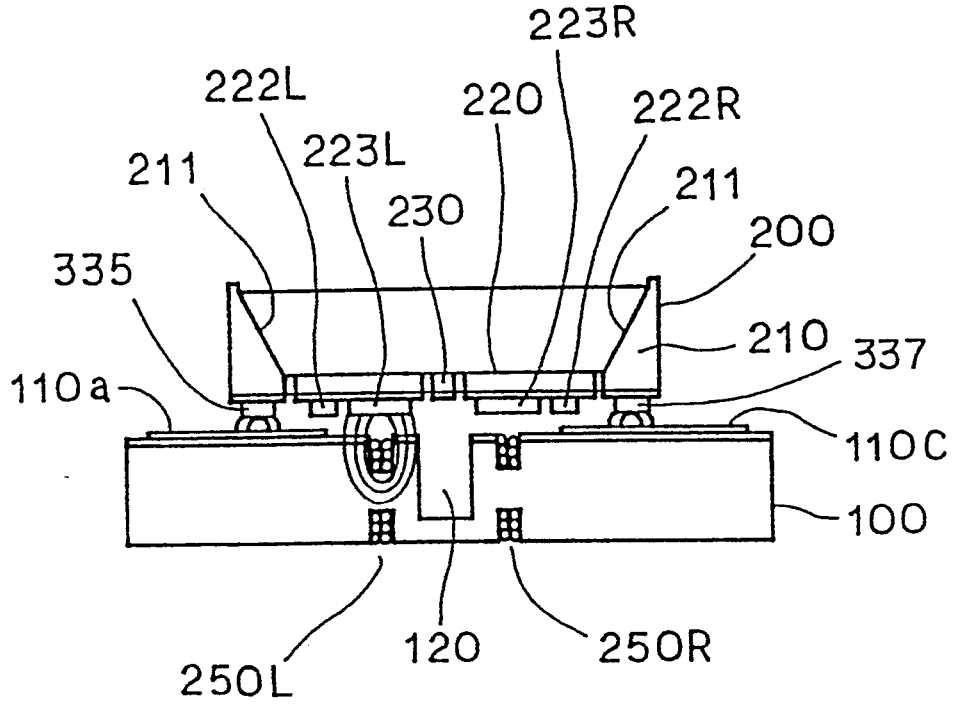
FIG. 8 is a view illustrating an operation of the microrelay shown in FIG. 1A.

When the electromagnetic coil 250L is excited, the magnetic body 223L is attracted to the electromagnetic coil 250L by a magnetic force generated by the electromagnetic coil 250L. The movable body 220 obtains a couple having the coupling sections 230 as an axis, thereby moving in a direction of an arrow $\alpha$ about the coupling sections 230 as an axis. As a result, the movable contact 222L of the wing 221L of the movable body 220 is contacted on the fixed contacts 110*a* and 10*b* on the substrate 100, thereby electrically connecting the movable contact 222L and the fixed contacts 110*a* and 110*b*. As is shown in FIG. 8, the magnetic flux from the electromagnetic coil 250L is transmitted only through the magnetic body 223L but not through the magnetic body 223R due to the groove 120 as is shown in FIG. 8. Accordingly, the problem of the conventional microrelay that the movable body is entirely attracted to the substrate 100 is solved.

When the other electromagnetic coil 250R is excited, the movable body 220 obtains a couple having the coupling sections 230 as an axis, and thus moves in the opposite direction to the arrow $\alpha$. As a result, the movable contact 222R of the wing 221R of the movable body 220 is contacted on the fixed contacts 110*c*, 110*d* on the substrate 100, thereby electrically connecting the movable body 220 and the fixed contacts 110*c* and 110*d*. Needless to say, the same effect can be obtained in this case.

According to the microrelay of this example, a contact force of 1 to 5 g is obtained due to the efficient utilization of the magnetic force despite the compactness thereof. The response time is 0.05 to 0.1 sec. According to the present invention, the size of the substrate 100 can be reduced to approximately 2×2 mm or smaller while maintaining these characteristics.

The groove 120 has a further advantage as described below. Since due to the groove 120 as is described above, the movable contact 222L is attracted to the fixed contact 110*a* with a strong force. Accordingly, the moving area of the movable body 220 is enlarged, and as a result, a distance between the movable contact 222L and the fixed contact 110*a* is enlarged. In such a state, signal components leaked between the movable contact 222L and the fixed contact 110*a* are decreased. Thus, the transmission of high frequency signals is prevented, thereby improving the signal blocking capability of the microrelay. Needless to say, the microrelay functions in the same manner when the electromagnetic coil 250R is excited.

Although two pairs of fixed contacts 110*a* through 110*d* are provided on the substrate 100 in the above example, only one pair of fixed contacts or three or more pairs of fixed contacts may be provided. The movable contacts may be provided in an arbitrary number of pairs instead of one as in the above example.

Although one groove 120 is provided in the substrate 100 as the magnetic force controlling device in the above example, a plurality of grooves may be provided. The groove 120 is not necessarily extended from one end to the other end of the substrate 100 as is shown in FIG. 2A.

According to the present invention, due to a magnetic force controlling device, the magnetic force generated by each of a pair of magnetic force generating devices can be applied to a desirable magnetic body with a high efficiency. Thus, the whole microrelay including the magnetic force generating devices can be produced in a small size without lowering the pressure load. The magnetic force controlling device further prevents the inconvenience that a fixed contact attracts a movable contact which should not be attracted as well as a movable contact which should be attracted by the application of the magnetic force.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A microrelay including a substrate having a pair of fixed contacts fixed on a surface thereof and a movable section having a pair of movable contacts opposed to the pair of fixed contacts, wherein:

the movable section comprises:

a frame for fixing the movable section to the substrate;

a movable body having the pair of movable contacts and a pair of magnetic bodies; and a coupling section for pivotally supporting the movable body to the frame;

and the substrate has:

a pair of magnetic force generating devices corresponding to the pair of magnetic bodies for selectively generating a magnetic force, a selected one of the pair of magnetic force generating devices generating the magnetic force and supplying one of the pair of magnetic bodies corresponding to the selected magnetic force generating device with the magnetic force so as to selectively cause contact between one of the pair of movable contacts and the fixed contact opposed to the one of the pair of movable contacts; and magnetic force controlling means for prohibiting transmission of a magnetic flux therethrough so as to allow the magnetic force generated by the selected magnetic force generating device to be applied only to the one of the pair of magnetic bodies corresponding to the selected magnetic force generating device and to disallow the magnetic force to be applied to the other one of the pair of magnetic bodies.

2. A microrelay according to claim 1, wherein the magnetic force controlling means is a groove formed at the surface of the substrate, and the groove is positioned so as to separate the pair of magnetic force generating devices from each other.

3. A microrelay according to claim 2, wherein the groove includes a diamagnetic member provided therein.

4. A microrelay according to claim 2, wherein the pair of magnetic force generating devices are a pair of electromagnetic coils wound around the substrate, and the electromagnetic coils are opposed to each other with the groove therebetween, a selected one of the pair of electromagnetic coils being selectively electrified so as to generate the magnetic force.

5. A microrelay according to claim 4, wherein the groove includes a diamagnetic member provided therein.

6. A microrelay according to claim 1, wherein the substrate further has at least one pair of fixed contacts having an identical construction with that of the pair of fixed contacts.

7. A microrelay according to claim 2, wherein the substrate further has at least one pair of fixed contacts having an identical construction with that of the pair of fixed contacts.

8. A microrelay according to claim 1, wherein the frame, the movable body and the coupling section of the movable section are formed of a single crystalline silicon.

9. A microrelay according to claim 2, wherein the frame, the movable body and the coupling section of the movable section are formed of a single crystalline silicon.

10. A method for producing a microrelay including a substrate having at least one pair of fixed contacts on a top surface thereof and a movable section having a pair of movable contacts opposed to the pair of fixed contacts, the method comprising the steps of:

depositing an insulating film on the top surface of the substrate;

depositing a conductive film on the insulating film and selectively etching away a portion of the conductive film so as to form the pair of fixed contacts;

forming a first groove on the top surface of the substrate between the pair of fixed contacts;

forming second and third grooves on the top surface of the substrate between the first groove and the respective ones of the pair of fixed contacts, the second groove being located between the first groove and one of the pair of fixed contacts and the third groove being located between the first groove and the other one of the pair of fixed contacts;

forming fourth and fifth grooves on a bottom surface of the substrate, the fourth groove being located at a portion corresponding to a portion of the second groove and the fifth groove being located at a portion corresponding to a portion of the third groove; and winding a conductive wire along the second and fourth grooves and winding another conductive wire along the third and fifth grooves for forming a pair of electromagnetic coils.

11. A method for producing a microrelay according to claim 10, further comprising the step of providing a diamagnetic member in the first groove.

12. A microrelay according to claim 3, wherein the diamagnetic member is one selected from a group consisting of antimony and bismuth.

13. A microrelay according to claim 5, wherein the diamagnetic member is one selected from a group consisting of antimony and bismuth.

14. A method according to claim 11, wherein the diamagnetic member is one selected from a group consisting of antimony and bismuth.

* * * * *

UNITED STATES PATENT AND TRADEMARK OFFICE

CERTIFICATE OF CORRECTION

PATENT NO. : 5,398,011

DATED : March 14, 1995

INVENTOR(S) : Kazuhiro KIMURA et al

It is certified that error appears in the above-indentified patent and that said Letters Patent is hereby corrected as shown below:

IN THE TITLE PAGE:

Item [75], the first name of the first inventor "Kimura" is mistyped as "Kasuhiro" and should read -- Kazuhiro --.

Column 5, line 33, after "of", "b" should be deleted.

Column 6, line 50, "10b" should read -- 110b --.

Signed and Sealed this

Twenty-third Day of May, 1995

Bruce Lehman

*Attest:*

BRUCE LEHMAN

*Attesting Officer*

*Commissioner of Patents and Trademarks*